US005231805A

United States Patent [19]

Sander

[11] Patent Number: 5,231,805

[45] Date of Patent: Aug. 3, 1993

[54] SURFACE CLEANING AND ASBESTOS REMOVAL MACHINE

[76] Inventor: James P. Sander, P.O. Box 99381, San Diego, Calif. 92109

[21] Appl. No.: 724,010

[22] Filed: Jul. 1, 1991

[51] Int. Cl.[5] ..... B24C 3/06; B24C 9/00

[52] U.S. Cl. ..... 51/429; 51/425; 51/319; 51/323

[58] Field of Search ..... 51/410, 424, 425, 428, 51/429, 430, 431, 432, 434, 321, 317, 318, 283 R, 323; 55/220; 261/116

[56] References Cited

U.S. PATENT DOCUMENTS

| | | | |
|---|---|---|---|
| 983,293 | 2/1911 | Kündig-Honegger | 261/116 |
| 1,809,922 | 6/1931 | Abramowitz | 261/116 |
| 3,034,262 | 5/1962 | Pawlson | 51/424 |
| 3,380,196 | 4/1968 | Mabille | 51/426 |
| 3,385,006 | 5/1968 | Miller | 51/410 |
| 3,407,538 | 10/1968 | Codina et al. | 51/429 |
| 3,608,968 | 9/1971 | Burnett | 51/176 |
| 3,877,175 | 4/1975 | Snyder | 51/425 |
| 3,900,968 | 8/1975 | Shigyo | 51/55 R |
| 3,900,969 | 8/1975 | Diehn | 51/424 |
| 4,178,724 | 12/1979 | Bruno | 51/178 |
| 4,319,436 | 3/1982 | Van Fossen | 51/424 |
| 4,377,922 | 3/1983 | Bergh | 51/428 |
| 4,377,923 | 3/1983 | Bergh | 51/424 |
| 4,377,924 | 3/1983 | Bergh | 51/429 |
| 4,406,092 | 9/1983 | Lake et al. | 51/425 |
| 4,984,397 | 1/1991 | Van Leeuwen | 51/425 |

*Primary Examiner*—Bruce M. Kisliuk
*Assistant Examiner*—Bryan Reichenbach
*Attorney, Agent, or Firm*—Jessup, Beecher & Slehofer

[57] ABSTRACT

A machine adapted to be maneuvered across a surface, typically a floor, in order to remove an unwanted coating such as asbestos and adhesive from the floor. An impeller hurls an abradent such as metal shot at an angle against the floor abrading the material which then rebounds along with the abradent up into a return channel where the abradent shot and the abraded material are separated. The shot is returned to the impeller. The abrasion takes place in a downward facing cavity. A wetting spray outside the cavity in advance of the forward end of the machine wets the surface in advance of the abrasion and creates a mist within the cavity which cools the flow of material rebounding from the surface. The presence of the mist greatly abates the dispersion of the abraded material permitting it to be discharged into a collecting drum without contaminating the ambient air.

9 Claims, 3 Drawing Sheets

SURFACE CLEANING AND ASBESTOS REMOVAL MACHINE

BACKGROUND OF THE INVENTION

1. Field of the Invention

Abrading: Mobile sandblasting type of machine with recovery means.

ABRADING PROCESSES: blasting with nonsiliceous abradant and with nonatmospheric fluid carrier. Vacuum canister connected to machine with flexible hose for depositing abraded material to maintain dust-free working environment. Pneumatically driven machine.

2. Description of the Prior Art

Bergh, U.S. Pat. No. 4,377,922; Bergh U.S. Pat. No. 4,377,923; and Bergh U.S. Pat. No. 4,377,924 all issued on March 29, 1983. The three Bergh patents illustrate various types of portable surface treating machines having inclined chambers and rotating impellers.

SUMMARY AND OPERATION OF THE INVENTION

The present invention is a surface cleaning and preparation machine. The machine can be used to clean and prepare any flat hard surface such as poured concrete or a series of metal plates placed adjacent to each other to form a floor. The machine also can be used for asbestos removal, or in the general renovation of buildings. It is very useful in the removal of old asbestos layers previously applied as insulation or as a fire retardant material to a surface. The present invention is also very useful in the removal of asbestos laden mastic adhesive or other types of commonly found cement pastes previously used or currently used in the building industry. The mastic adhesive and cement that need to be removed were originally applied to the surfaces of floors for cementing tiles, wood planking, carpet, or linoleum to floors. The old floor coverings are first removed by using conventional means to expose the mastic adhesives or cements. The old mastic adhesive layers and cements have to be removed before new floor coverings can be installed.

The present invention is transportable and easily maneuverable. It is compact, light in weight, and is mounted on a frame having two front braces with two front support wheels and a rear brace with a rear support wheel. There is an inclined rear handle with handle bars that the operator holds onto to maneuver the machine. The machine works according to the same principle as an upright vacuum cleaner works to clean and vacuum a carpet. The main body of the machine includes two hollow housings which form an upright generally V-shaped structure when viewed from either side of the machine. The rearwardly inclined housing at the back of the machine includes a broadcast chamber. The other, forwardly inclined, return housing includes a takeup collecting chamber. The open bottoms of the two housings merge to form a rectangular cavity called the abrasion cavity. A rectangular metal frame is mounted to and surrounds the abrasion cavity. The abrasion cavity is exposed to and faces the surface to be cleaned. The braces and wheels that mount and support the machine are set so that the bottom, flat surface of the rectangular frame is slightly above the surface to be prepared and cleaned.

The broadcast chamber of the housing has a strategically mounted broadcast wheel or impeller mounted in the chamber. The impeller is rotatable by a shaft attached to a pneumatic motor. The motor is mounted on the housing and outside of the broadcast chamber. A feed hopper is mounted between the rearward housing and the return housing. The feed hopper holds the abradant particles that are fed to the impeller in the broadcast chamber through a controlled feed duct. The impeller vanes receive the abradant particles and hurl the abradant particles centrifugally into the abrasion cavity and against the surface to be cleaned, bombarding the surface with the abradant particles. The abradant particles are preferably a fine metallic grit, or small pellets similar to the type of shot found in shotgun shells. The type of abradant particles used depends upon the job to be performed and the type of surface to be abraded by the machine. The prefered grit is fine enough so that it does not harm the surface that is being cleaned and abraded. Pellets or shot can impinge upon the surface and cause it to become slightly pitted, resulting in a roughened surface which may not be suitable for a particular renovation after the surface preparation has been finished.

When removing old mastic adhesive or cement paste, the abradant particles used are metallic grit or small metal pellets. The rectangular frame surrounding the abrasion cavity is made of a magnetic type of material such as a permanent iron magnet. The front and both side edges are fabricated from magnets. The rear transverse edge of the rectangular frame does not have to be fabricated from a magnetic material. There is a horizontal transverse rubber curtain or flap bolted to the bottom area of the nonmetallic rear edge of the frame. The purpose of the magnetized rectangular frame is to magnetically attract and contain the metallic abradant particles to prevent them from being ejected and dispersed out from underneath the perimeter of the magnetic frame. The rear flap or curtain allows for a small opening for outside air to enter the abrasion cavity. The curtain is also used to prevent the abradant particles from escaping from underneath the rectangular frame. As the abradant particles bombard and abrade the surface to be cleaned and prepared, a quantity of dust, dirt and contaminated debris is generated in the interior of the abrasion cavity and the takeup collecting chamber.

Outside air is continuously drawn into the machine, circulated through the machine's closed system, and then exhausted to the ambient air when the machine is in operation. About half of the outside ambient air that enters the machine is drawn into the abrasion cavity from underneath the rubber curtain. The other half of the ambient air entering the machine is drawn in from an air intake slot located on the separating chamber and just below where the upper end of the return housing communicates with the separating chamber. The separating chamber is located immediately above the forward portion of the feed hopper. The separating chamber separates the abraded material from the abradant particles. The lighter abraded material rises in the separating chamber, and the heavier abradant particles fall back into the feed hopper. There is a wire screen placed horizontally in the separting chamber above where the return housing communicates with the separating chamber. The screen prevents any abradant particles or larger chunks of abraded material from being transferred to the vent hose. Any chunks of abraded material larger than the mesh of the screen are recycled until they are broken into small enough sizes to pass through the screen mesh. There is a top deflector that extends horizontally from the vertical wall of the separating chamber. The top deflector is attached to the wall adjacent to the top of the opening where the return housing opens into the separating chamber. There is a bottom deflector at the bottom of the separating chamber and mounted on the wall opposite that of the top deflector. There is an outside air intake slot located just below the opening where the return housing opens into the separating chamber. The two deflectors form a chute for the air flow. The incoming air from the outside air slot creates a turbulence in the area between the two deflectors, which helps in separating the metallic grit from the abraded debris. This is the area where the mixture of abradant particles and the abraded material separate. The aerodynamic forces separate the abradant particles from the abraded material. The upper wall portion of the separating chamber has a circular outlet hub, which is located above the screen. The hub is coupled to one end of a long flexible four inch diameter vacuum vent hose. The end of the hose is secured to the hub with a clamp. The abraded material exits out to the vent hose from the separating chamber, and the abradant particles return to the feed hopper.

There are a pair of 55 gallon depository drums placed adjacent to the area to be cleaned and prepared, but remotely positioned away from the abrading machine. Each drum can be described as a vacuum canister. The drums have casters for easy maneuverability. The 4 inch diameter vacuum vent hose has one end connected to the hub on the separating chamber and its other end connected to one end of an S-shaped elbow joint. The elbow joint is mounted and sealed on the lid of the first drum so that half of the joint is above the lid and the other half is below the lid. The end of the vent hose slips over the exposed open end of the elbow joint and can be secured with a clamp. The removable lid seals the top of the first depository drum. The drums are used to store the abraded material that is removed from the surface being abraded and cleaned. The lids of the two drums also are interconnected with a short 4 inch diameter vent hose. There is a sealed elbow joint on each lid for connecting the second vent hose between the two drums. The second depository drum also has a sealable removable lid. The second lid or cover has three electric vortex fan motors mounted on it. Each one of the fans on the vortex motors draws air from the interior of the second drum, and then filters and vents clean air into the surroundings of the building area where the work is being performed. All the abraded material generated as a result of the operation of the machine is trapped and deposited in both drums. None of the abraded material is allowed to escape. The vacuum created by the plurality of electric motors venting air from the second drum causes system air to flow from the first drum through the interconnecting vent hose and into 'he second drum. This displacement of air in turn causes air to flow from the separating chamber on the abrading machine to the first drum via the 4 inch diameter flexible vent hose connecting the separating chamber to the lid on the first drum.

There are two places where ambient outside air can enter the machine. Outside air enters at the bottom perimeter of the magnetic frame where the rubber curtain or flap is positioned. There is also a horizontal air intake slot located below where the top open end of the return housing connects to the separating chamber. The outside ambient air is drawn in from both locations. The air flow through the system is about 500 cubic feet per minute at the second drum where the vacuum motors are transferring air from the system to the outside. The continuously upwardly circulating air from the abrasion cavity, into the takeup collecting chamber, into the separating chamber, and out to the remotely positioned drums causes all the grit, dust, and debris, collectively referred to as the abraded material, to be transferred to the depository drums.

The separating chamber located above the treminus of the takeup collecting chamber has a screen and a top deflector to deflect abradant particles to the feed hopper for recycling in the machine. The heavier weight of the abradant particles causes them to fall by gravity and back into the feed hopper of the machine to be reused again. The abraded material, including the dust, will be sucked in to and transferred through the vent hose into the first drum. About 95% of the abraded material is deposited in the first drum. Any finer abraded material that is still airborne will be transferred to the second drum. The exhaust fan motors on the second drum have HEPA filters around them to trap any particulate matter to prevent it from escaping into the ambient air. HEPA is an acroynym for high elimination particulate air filter. This safety feature is extremely important when removing any asbestos laden surface material, because airborne asbestos particles can be very dangerous when inhaled by the operator.

The feed hopper can hold up to 20 pounds of abradant particles. Ten pounds of metallic grit works well when abrading a mastic covered surface. There is a butterfly valve in the gooseneck of the feed duct connecting the bottom of the feed hopper to the broadcast chamber. The valve can be controlled by the operator of the machine. There is a manually contolled lever mounted on the handle. The lever has a wire connected to the butterfly valve. When the butterfly valve is fully open, the machine is recycling the abradant material from the feed hopper through the gooseneck feed duct into the broadcast chamber, bombarding the surface to be cleaned by the impeller, drawing up the particles and material into the takeup collecting chamber, transferring the particles and material to the separating chamber, and then redepositing the abradant particles into the feed hopper. Very little of the abradant particles is lost because of this recycling process. The abraded material is deposited in the pair of drums during the operation of the machine.

There is a storage bin located above the feed hopper and adjacent to the separating chamber. The storage bin holds a supply of abradant particles. A vertical tube with a built-in valve connects the bottom of the bin to the feed hopper. The valve can be opened to allow additional abradant particles to fill the feed hopper to the desired level. The feed hopper is a cone-shaped configuration. When the machine is stopped and the storage bin valve is opened, the particles will flow into the feed hopper until they reach the level of the bottom of the feed tube. The valve is then shut off. This is the normal level of the abradant particles in the feed hopper.

The pneumatic motor that rotates the broadcast wheel is controlled by a manually operable feed control air valve mounted on the handle. Compressed air is supplied to the air valve by an outside air line from a remotely located pressurized air supply. There is an air line connecting the air valve to the pneumatic motor to supply compressed air to the pneumatic motor. The air valve is usually preset to a standard pressure to rotate the broadcast wheel at a fixed r.p.m. The operator monitors the air pressure gauge on the air valve to ensure that sufficient pressurized air is being supplied to the pneumatic motor.

The operator pushes the abrading machine over the surface area to be cleaned by holding onto the handle bars at the end of the handle. The machine is light enough so that it can be manually maneuvered and pushed across the surface to be cleaned with relative ease.

The machine has a pair of water spray nozzles mounted on the front of the machine. One water nozzle is mounted on the left front brace above the left wheel. There is a water line connecting the sprayer to a water valve mounted on the handle. The other water spray nozzle is mounted on the right front brace above the right wheel. There is another water line connecting the second sprayer to the water valve on the handle. The water valve is manually operable. The operator can shut off or control the amount of water supplied to the two front water sprayers through the two water lines by adjusting the water valve on the handle. The manually operable water pressure valve can control the amount of water sprayed at the front of the machine. There is a third water line terminating at the water valve to supply water to the water sprayer. The third water line enters the vent hose at the hub on the separating chamber and winds its way all the way through the vent hose to a Y-shaped coupling located above the S-shaped elbow on the lid of the first drum. The third water line is coupled to one fork of the Y-shaped coupling. There is a third water spray nozzle mounted at the bottom mouth of the S-shape elbow. There is a fourth water line that connects between the other fork of the Y-shaped coupling and the third water line. There is a high pressure flexible water line connecting the head of the Y-shaped coupling to a remotely positioned high pressure water pump. The purpose of the high pressure water pump is to force water at a high pressure out the two spray nozzles located at the front of the machine and to the spray nozzle located in the first drum at the mouth of the S-shaped elbow. Since the water is under such high pressure, around 400 p.s.i., the water turns into a very fine mist when it exits the water spray nozzles at the sprayers. As the operator is using the machine and is walking forward, the two water spray nozzles form a fan-like spray in front of the surface just before it is passed over by the rectangular frame. Both water nozzles are adjusted so that they form a water curtain at a certain angle relative to the surface to be cleaned. As the machine is passed over the surface just after it has been wetted down, the water will continue to mist. It is drawn into the abrasion cavity of the machine as the machine is being operated. This fine water mist will continue to remain within the interior components of the machine and will provide a water film on all the interior components of the machine. The process of centrifugally hurling the metallic abradant particles in the chambers and cavity and onto the surface generates a lot of internal heat. The water misting has a frosting effect and cools down the interior compartments to prevent any heating of the interior compartments. The water misting also tends to wet the dust and abraded material sufficiently so that they will not be blown about too much. The water vapor also helps to neutralize any acidic abraded material. The wetted abraded material is treated again with a water spray as the abraded material enters the interior of the first drum after passing through the vent hose. This water misting treatment results in 95% of all the abraded material generated in the machine to be deposited in the first drum. As stated before, any remainder of the residual airborne abraded material will be transferred to the second drum and deposited or filtered out by the air filters surrounding the vacuum fan motors.

The drums used to collect the dust are a special type of DOT approved drum. When the first drum becomes filled with abraded material, the lid is removed and placed on an empty replacement drum. The filled drum is covered with a special lid and is sealed and locked. The full sealed drum is shipped to a proper waste disposal facility. The drums used are specially certfied by the Department of Transportation. The drums are known as DOT-H17 drums. This procedure prevents all the asbestos laden particles from escaping and having harmful effects to nearby workers. The machine also has a safety feature in that there are no electrical wires connected directly to the machine itself. The high pressure water pump can be powered either by electricity or some other portable power system. In either event, the water pump is placed remotely from the area to be cleaned. The two drums with the electric vacuum motors are also placed remotely from the machine to eliminate any possibility of an electric shock to the operator while operating the machine on the wet surface.

The present invention finds particular application for the removal of black mastic adhesive or cement paste applied to a floor when the tiles were laid. Up until approximately ten years ago, it was quite common to mix the black mastic with asbestos fibers to give more body and bulk to the mastic. The tile workers would trowel the black mastic with asbestos fiber mixture. They would trowel with a serrated edge leaving a mastic approximately one eighth inch thick. The individual tile pieces or linoleum were laid over this black mastic to adhere or cement the tile to the floor. When a building is being renovated, or the tile replaced, the tiles first have to be removed. Then the underlying mastic adhesive and asbestos mixture also have to be removed. However, because of the asbestos fibers mixed in with the mastic cement, it is considered unsafe for the worker to remove the mastic by conventional means. The present invention is very useful in removing this asbestos laden mastic. The water mist keeps the interior of the machine cool. The water vapor also prevents the mastic, from melting or becoming sticky, thus preventing it from sticking to the impeller and surfaces of the interior, with danger of clogging of the machine. The water vapor in the interior keeps a wet film on the interior surfaces to prevent any mastic adhesive from sticking to the interior surfaces. The cooling effect of the water also prevents the mastic from becoming soft and pliant. The mastic adhesive keeps its brittleness so that it can be easily transferred through the machine's vacuum system and into the drums for permanent deposition and eventual burial in a landfill.

DETAILED DESCRIPTION OF THE INVENTION

Figure 6:
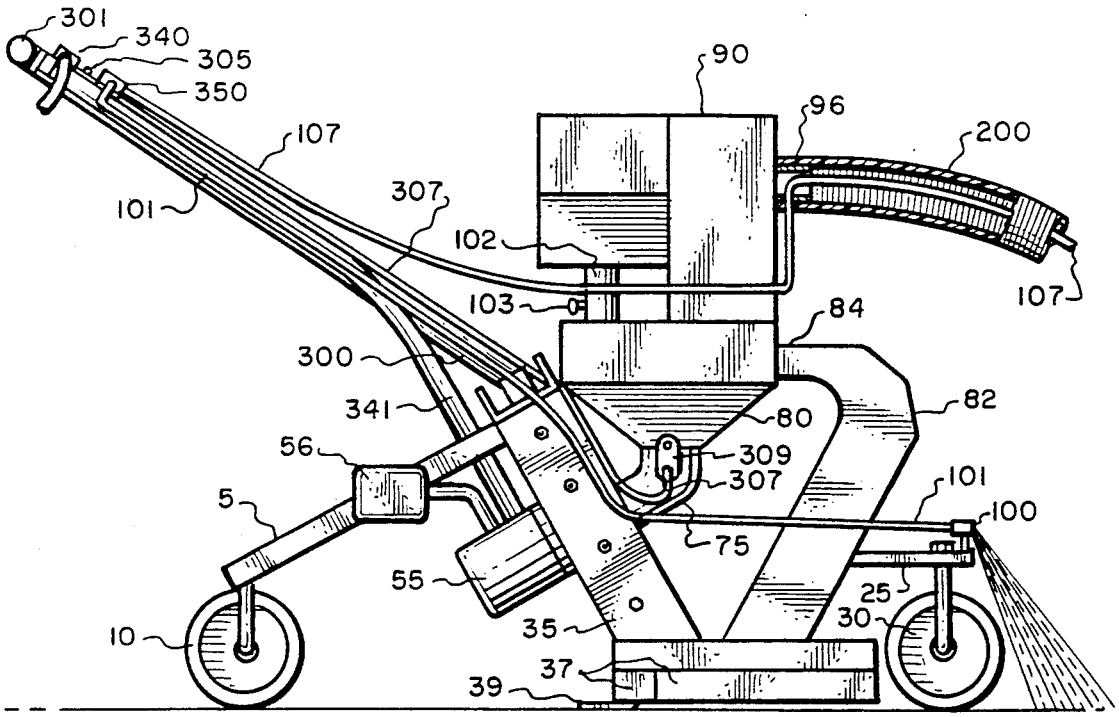
FIG. 6 is a right side elevational view of the invention.

The present invention will now be described in greater detail as follows:

FIG. 6 shows a right side elevational view of the surface cleaning ard asbestos removal machine. The machine has a wheel supported frame means illustrated as a U-shaped rear brace 5 having a single support wheel 10 mounted to it, a left front brace 15 (FIG. 2) having a wheel 20 mounted to it, and a right front brace 25 also having a wheel 30 mounted on it. The three braces 5, 15, and 25 with their three support wheels 10, 20 and 30 maintain the flat bottom portion of the present invention slightly above the surface to be cleaned. The braces and wheels that form the frame also allow the operator to easily manuever the present invention, since the machine is mounted on wheels.

Figure 2:
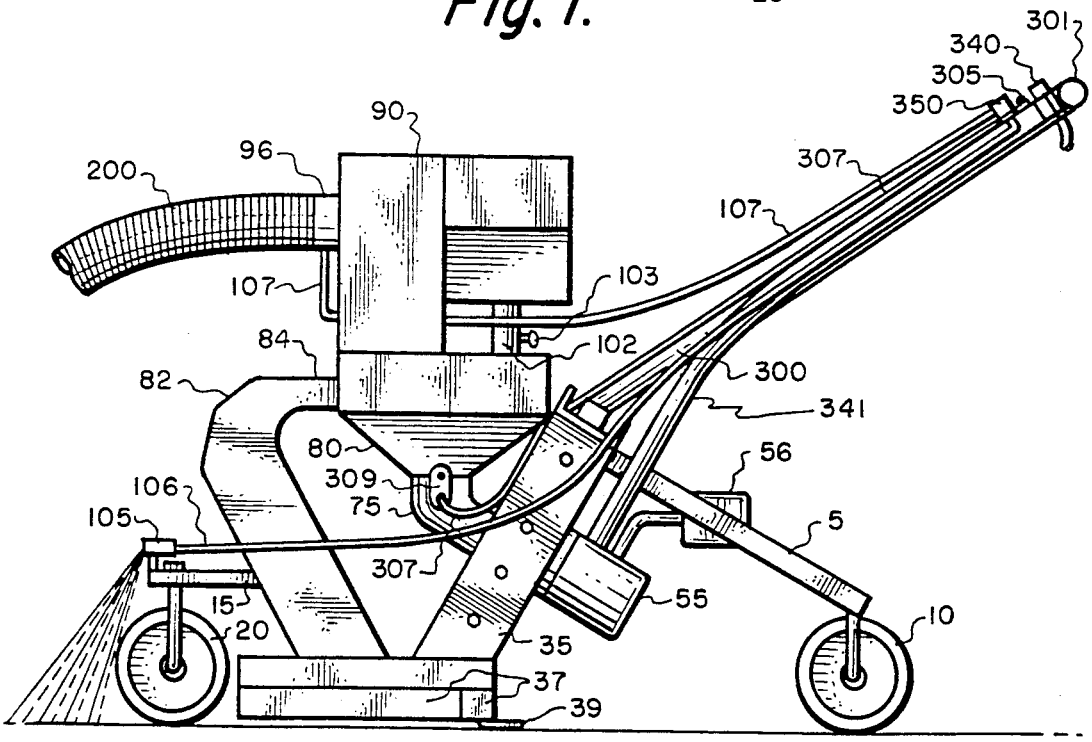
FIG. 2 is a left side elevational view of the surface preparation, abrading machine, illustrating a portion of the vent hose, which connects to the vacuum canisters.
Figure 3:
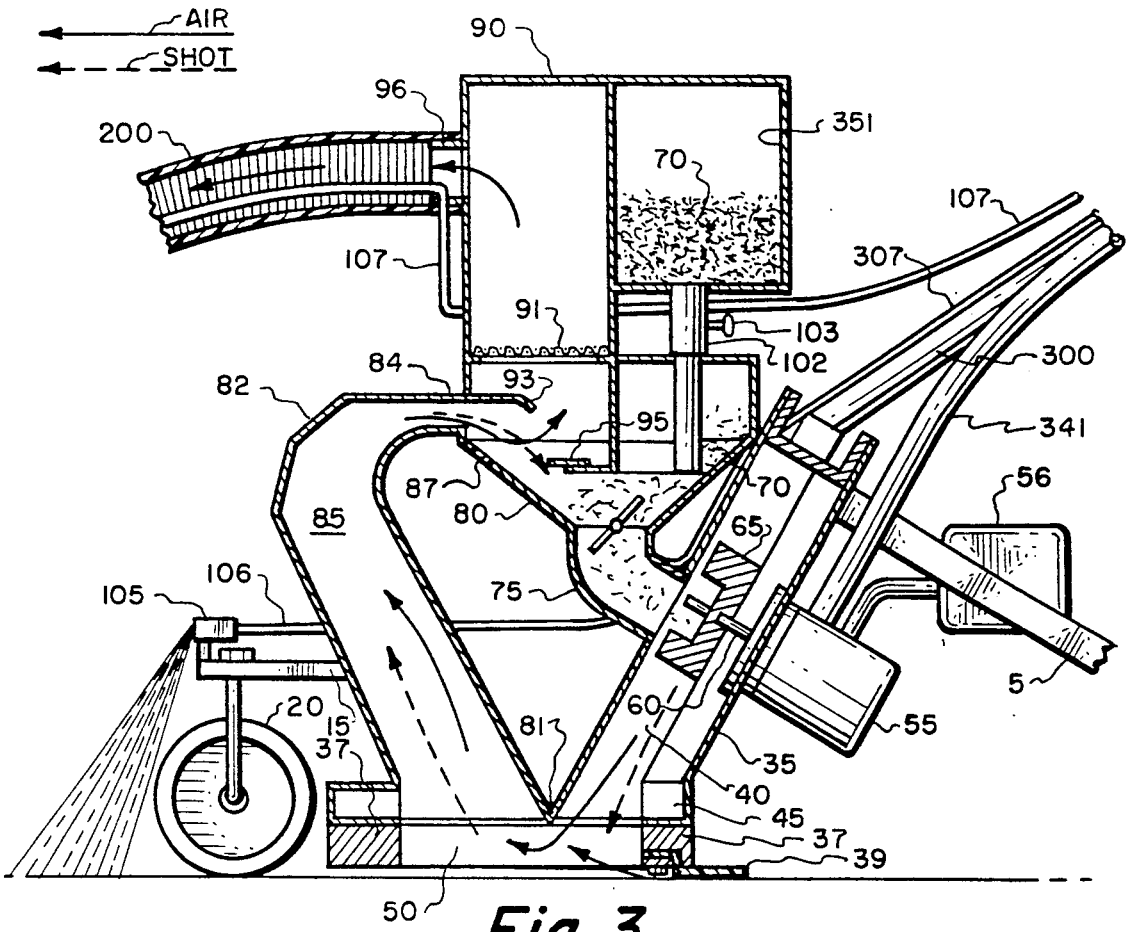
FIG. 3 is a vertical medial sectional view of the surface preparation machine taken along the line 3—3 of FIG. 5 illustrating the flow of the abradant particles, their impaction upon the surface to be cleaned, and the abraded material being separated from the abradant particles. The abraded material enters the vent hose and is transferred to the vacuum canisters.
Figure 4:
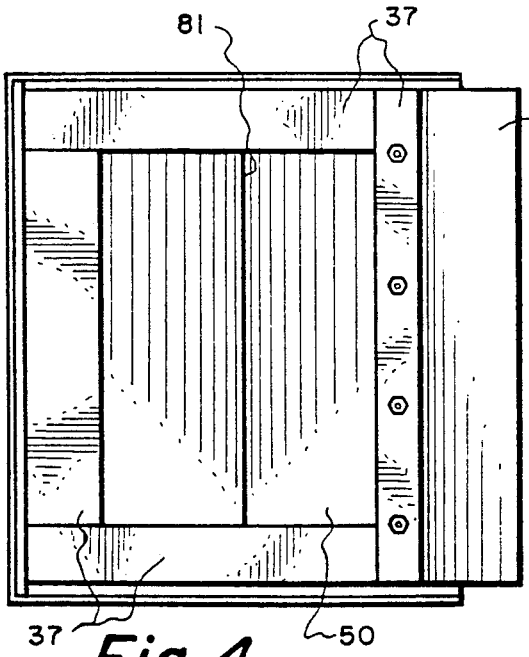
FIG. 4 is a bottom view of the rectangular frame and the abrasion cavity of the surface cleaning machine.

FIG. 2 illustrates the left side elevational view of the machine. FIG. 3 illustrates the left side elevational view of the present invention in a sectional view to illustrate the interior areas of the various compartments of the machine. There is a housing means illustrated as a rearwardly inclined rear housing 35 mounted to the frame, and a return housing 82 that is forwardly inclined. The two housing portions form a V-shape ir profile. The angle of the V-shape can be variable but should be less than 45 degrees. The tip of the V-shape where the rear and forward portions of the housing meet are welded together. The bottom area is open. The rear housing 35 has a broadcast chamber 40 that is inclined at an acute angle relative to the surface to be cleaned or prepared. The bottom 45 of the housing is open. There is an abrasion cavity means illustrated as an abrasion cavity 50, which communicates with the open bottom 45 of the rear and forward housing. The abrasion cavity 50 is transversely partitioned beneath the rear housing 35 and the forward housing 82. The partitioning is effected by the front wall of the housing 35 meeting the rear wall of the housing 82 at the V junction 81. The abrasion cavity 50 is surrounded by a rectangular frame 37 made of 4 metal bars welded or otherwise fastened together. The rectangular frame of metal has a rectangular opening as is clearly illustrated in FIG. 4. The front, left, and right sides of the rectangular frame are fabricated from a magnetic type of material such as a permanent iron magnet. The rear side of the rectangular frame does not have to be fabricated from a magnetic type of material. The rectangular frame 37 acts as a skirt to surround the abrasion cavity 50. The rear side of the frame has a transversely and horizontally positioned rubber curtain or flap 39 bolted to it. The rubber curtain 39 prevents the abradant particles from escaping from the rear of the abrasion cavity, but still allows outside air to enter or to be drawn into the interior chamber of the machine, e.g., the abrasion cavity 50. The rear portion or trailing edge of the curtain 39 extends slightly beyond and behind the rear edge of the magnetic frame 37. The magnetic sides of the frame prevent the abradant material, which is usually metallic, from escaping and dispersing from underneath the abrasion cavity 50 to prevent loss of the expensive abradant particles. The magnetic frame attracts the abradant particles to prevent the particles from being ejected from underneath the perimeter of the frame 37.

In the Figures, there is a motor means illustrated as a pneumatic motor 55. The motor 55 has a rotatable drive shaft 60. Part of the shaft is positioned in the broadcast chamber 40. There is a muffler 56 connected to the pneumatic motor 55. The muffler also has a filter to collect any contaminated material. There is a broadcast means illustrated as a broadcast wheel 65 or impeller mounted at one end of the shaft 60. The broadcast wheel is about six inches in diameter and has vanes. The broadcast wheel 65 is stategically positioned in the broadcast chamber 40. The broadcast wheel 65 receives abradent particles 70 and centrifugally hurls them into the abrasion cavity 50 and against the surface to be cleaned and prepared. The hurled abradent particles 70 cause the surface immediately below the magnetic frame 37 to be abraded and cleaned by the abradent particles 70. In the Figures, there is a hollow feed duct means illustrated as a feed duct 75, which feeds abradent particles 70 to the broadcast wheel 65. A feed hopper 80 is illustrated in the Figures. The feed hooper 80 is located above the feed duct 75. The feed hopper 80 is designed to hold a quantity of new and recycled abradent particles 70, and functions to feed abradent particles 70 to the broadcast wheel 65 through the feed duct 75.

A return housing means is illustrated in the Figures as a return housing 82. The return housing 82 has a take up collecting chamber 85. The collecting chamber 85 communicates with the abrasion cavity 50. The collecting chamber is designed to receive abradent particles 70 and any abraded material that is dislodged from the surface being cleaned as a result of being bombarded by the abradant particles 70. Any dust, grit, or other refuse that is produced as a result of the cleaning process is drawn up by the circulating air. The dust, grit, and abradant particles are drawn into the collecting chamber 85 by the up draft of the air flow.

A separating chamber means is illustrated in the Figures as a separating chamber 90. It is included as part of the return housing 82. The separating chamber 90 receives the abradent particles 70 and the abraded material. The separating chamber 90 allows the abraded material to separate from the abradent particles 70 so that the abradent particles 70 can be returned to the feed hopper 80 and recycled.

Outside air is continuously drawn into the machine, circulated through the machine's closed system, and then exhausted to the ambient air when the machine is in operation. About half of the outside ambient air that enters the machine is drawn into the abrasion cavity 50 from underneath the rubber curtain 39. The other half of the ambient air entering the machine is drawn in from an air intake slot 87 located on the separating chamber 90 and just below where the upper end 84 of the return housing 82 communicates with the separating chamber 90. The intake slot 87 is covered with a wire screen. It is about ten inches long and about one-quarter inch wide. The separating chamber 90 is located immediately above the forward portion of the feed hopper 80. The separating chamber 90 separates the abraded material from the abradant particles 70. The lighter abraded material rises in the separating chamber 90, and the heavier abradant particles 70 fall back into the feed hopper 80. There is a wire screen 91 placed horizontally in the separating chamber 90 above where the top 84 of the return housing 82 communicates with the separating chamber. The screen 91 prevents any abradant particles or larger chunks of abraded material from being transferred to the vent hose 200. Any chunks of abraded material larger than the mesh of the screen 91 are recycled until they are broken into small enough sizes to pass through the screen mesh 91. There is a top deflector 93 that extends horizontally from the vertical wall of the separating chamber 90. The top deflector 93 is attached to the wall adjacent to the top of the opening 84 where the return housing opens into the separating chamber. There is a bottom deflector 95 at the bottom of the separating chamber and mounted on the wall opposite that of the top deflector 93. The outside air intake slot 87 is located just below the opening where the return housing opens into the separating chamber. The two deflectors 93 and 95 form a chute for the air flow. The incoming air from the outside air slot 87 creates a turbulence in the area between the two deflectors, which helps in separating the metallic grit from the debris. This is the area where the mixture of abradant particles and the abraded material separate. The aerodynamic forces separate the abradant particles from the abraded material. The upper wall portion of the separating chamber has a circular outlet hub 96, which is located above the screen 91. The hub 96 is coupled to one end of a long flexible four inch diameter vacuum vent hose 200. The end of the hose 200 is secured to the hub 96 with a clamp. The abraded material exits out to the vent hose 200 from the separating chamber 90, and the abradant particles return to the feed hopper 80.

There is a water sprayer means illustrated as a pair of spray nozzles 100 and 105 mounted at the front of the machine for wetting the surface to be prepared just before the machine is passed over the surface and is abraded by the abradent particles 70. The sprayer nozzles, water lines, and high pressure water pump will be discussed in greater detail, infra.

Figure 1:
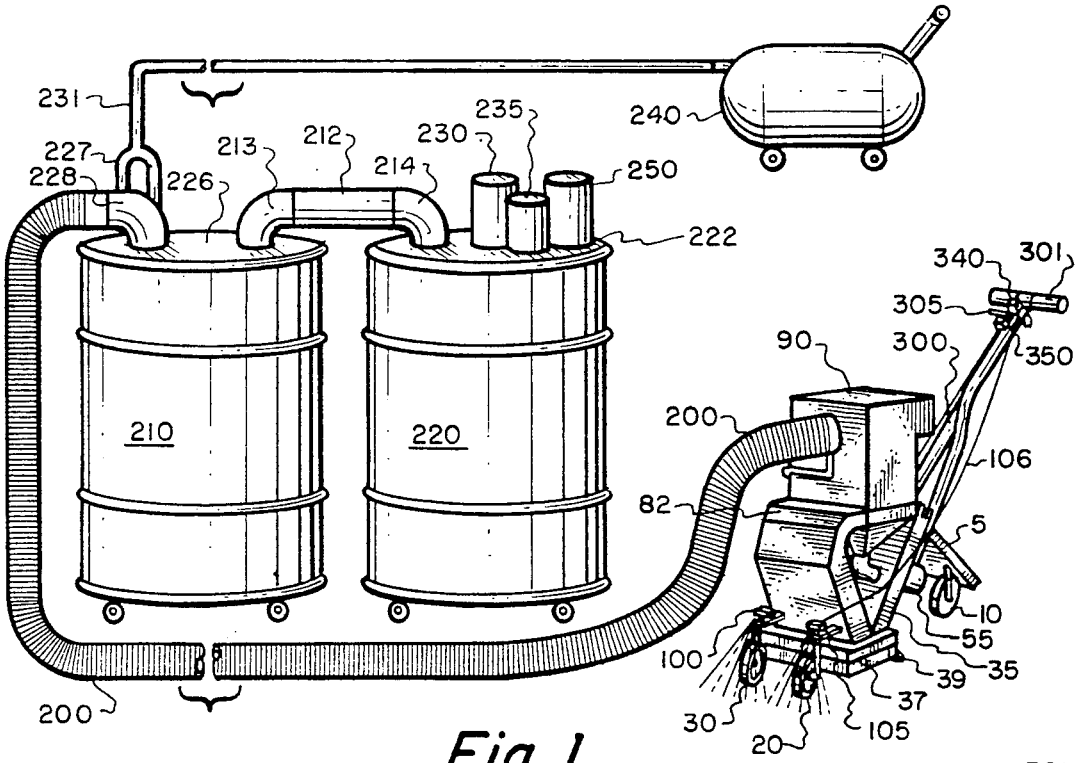
FIG. 1 is a perspective view of the components comprising the invention showing the environment in which it is used. The vacuum canisters are illustrated as located remotely from the surface preparation, abrading machine, and are shown for illustration purposes as enlarged relative to the surface preparation machine. The high pressure water pump is also illustrated remotely postioned from both the canisters and the surface cleaning machine to eliminate any possibility of electric shock to the operator of the machine.
Figure 7:
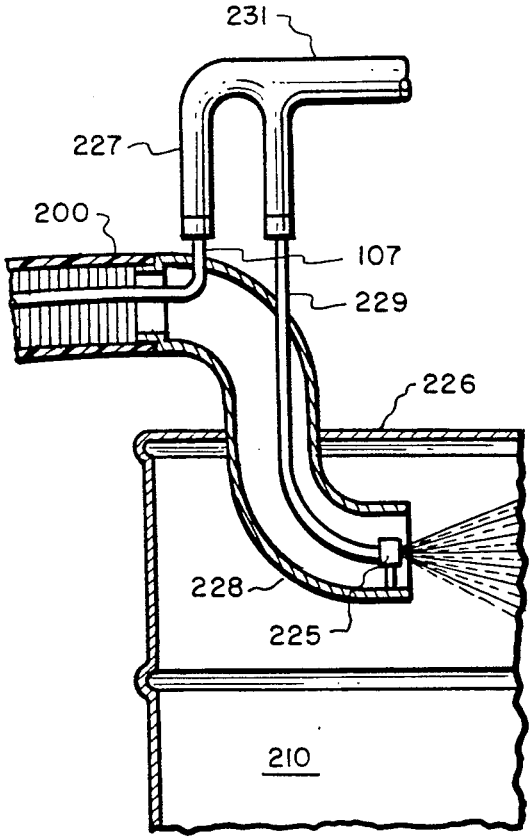
FIG. 7 is a partial sectional view of the S-shaped elbow mounted on the first lid, the Y-shaped water coupling, the water sprayer in the first drum, and the two water lines.
Figure 8:
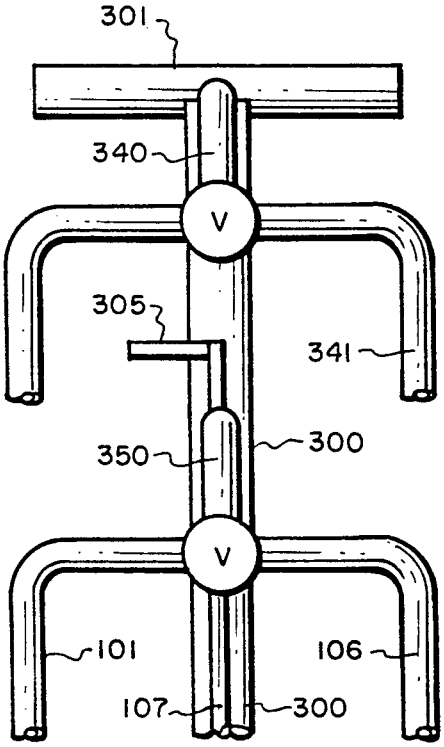
FIG. 8 is a partial sectional view of the end of the handle portion of the invention showing the water, air, and abradant particle manually operable control valves. The water lines, air lines, and the butterfly wire are also illustrated.

The flexible hose means 200 is connected between the separating chamber 90 on the machine and a pair of vacuum canister means 210 and 220 illustrated as 55 gallon drums in FIG. 1. The drums are specially certified DOT-H17 drums for transporting and disposing of toxic materials. The flexible hose means 200 is approximately four inches in diameter and is shaped much like a clothes dryer vent hose. The pair of canister means 210 and 220 has filter means that removes the abraded material from the separating chamber 90 and deposits the abraded material in the canisters. There is also illustrated a water sprayer means in canister 210 shown as a spray nozzle or mister 225 in FIG. 7 that wets down the abraded material as it enters the first canister and is deposited in the canisters 210 and 220. About 90% of the contaminated adraded material is deposited in the first drum or canister 210. The water sprayer or mister 225 is connected to a Y-shaped coupling 227 above the lid 226 of the first drum 210. The Y-shaped coupling is connected by a flexible water line 231 to a remote water pump 240. The remotely located water pump 240 provides water at around 400–500 p.s.i. to the sprayer 225 in the first drum 210 and to the sprayers 100 and 105 located at the front of the machine. The high pressure water causes a very fine misting that immediately wets down the incoming abraded material and causes the material to accumulate in the drum 210.

There is a means for supplying a vacuum to the canisters 210 and 220. There is a short vacuum hose means 212 interconnecting the two drums 210 and 220. There are a pair of elbows 213 and 214 mounted on both lids to interconnect the hose 212. There is a second removable lid 222, onto which is mounted one end of the hose 212 and two motors 250 and 230. There is a third back-up motor 235. The motors with impleller fans create a vacuum in the second drum 220. The air is drawn from the interior of the second drum 220 and is then exhausted to the outside by the motors 250 and 230. In order to capture any remnant contaminated abraded material as the air is exhausted to the outside, there are sleeve filters placed around the motors 250, 230, and 235 to remove any left over suspended material. The sleeve filters are H.E.P.A. filters. The continuing withdrawal of the air from the second drum causes air and abraded material to be drawn from the separating chamber 90 and the takeup collecting chamber 85. About half of the air enters the system from the open bottom 45. The other half is drawn into the system from the horizontal air intake slot 87 located below the separating chamber. The air flow in the system can range from 300 to 700 cubic feet per minute.

The machine has a pair of water spray nozzles 100 and 105 mounted on the front of the machine. One water nozzle 105 is mounted on the left front brace above the left wheel 20. There is a water line 106 connecting the sprayer to a water valve 350 mounted on the handle 300. The other water spray nozzle 100 is mounted on the right front brace above the right wheel 30. There is another water line 101 connecting the second sprayer 100 to the water valve 350 on the handle. The water valve is manually operable. The operator can shut off or control the amount of water supplied to the two front water sprayers 100 and 105 through the two water lines 101 and 106 by adjusting the water valve 350 on the handle. The manually operable water pressure valve can control the amount of water sprayed at the front of the machine. There is a third water line 107 terminating at the water valve to supply water to the water sprayer 100. The third water line 107 enters the vent hose 200 at the hub 96 on the separating chamber 90 and winds its way all the way through the vent hose to a Y-shaped coupling 227 located above the S-shaped elbow 228 on the lid 226 of the first drum 210. The third water line 107 is coupled to one fork of the Y-shaped coupling 227. The third water spray nozzle 225 is mounted at the bottom mouth of the S-shape elbow, 228. There is a fourth water line 229 that connects between the other fork of the Y-shaped coupling 227 and the third water sprayer 225. There is a high pressure flexible water line 231 connecting the head of the Y-shaped coupling 227 to a remotely positioned high pressure water pump 240. The purpose of the high pressure water pump is to force water at a high pressure out the two spray nozzles 100 and 105 located at the front of the machine and to the spray nozzle 225 located in the first drum 210 at the mouth of the S-shaped elbow 228. Since the water is under such high pressure, around 400 p.s.i., the water turns into a very fine mist when it exits the water spray nozzles at the sprayers. As the operator is using the machine and is walking forward, the two water spray nozzles form a fan-like spray in front of the surface just before it is passed over by the rectangular frame 37. Both water nozzles are adjusted so that they form a water curtain at a certain angle relative to the surface to be cleaned. As the machine is passed over the surface just after it has been wetted down, the water will continue to mist. It is drawn into the abrasion cavity of the machine as the machine is being operated. This fine water mist will continue to remain within the interior components of the machine and will provide a water film on all the interior components of the machine. The process of centrifugally hurling the metallic abradant particles in the chambers and cavity and onto the surface generates a lot of internal heat. The water misting has a frosting effect and cools down the interior compartments to prevent any heating of the interior compartments. The water misting also tends to wet the dust and abraded material sufficiently so that they will not be blown about too much. The water vapor also helps to neutralize and acidic abraded material. The wetted abraded material is treated again with a water spray as the abraded material enters the interior of the first drum after passing through the vent hose. This water misting treatment causes 95% of all the abraded material generated in the machine to be deposited in the first drum 210. As stated before, any remainder of the residual airborne abraded material will be transferred to the second drum 220 and deposited or filtered out by the air filters surrounding the vacuum fan motors 250, 230 and 235.

FIGS. 1, 2, 3 and 8 also illustrate an inclined handle 300 extending upwardly and rearwardly from the frame. The handlebar 301 is used to maneuver the device by the operator. The handle has mounted to it an abradant particle valve control means for controlling the amount of abradant particles 70 fed to the broadcast wheel 65. The particle control means is illustrated as a lever 305 attached to the handle, a wire 307 running the length of the handle, and connected to a butterfly valve 309 positioned in the feed duct 75. Additionally, there is an air line means mounted on the handle and extending to the pneumatic motor 55 for supplying compressed air to the motor 55. There is another means 340 mounted on the handle for manually controlling the air flow to the motor 55 and thereby controlling the RPM of the broadcast wheel. The manually operable air flow control 340 is attached to an air line 341 extending from the pneumatic motor 55.

Figure 5:
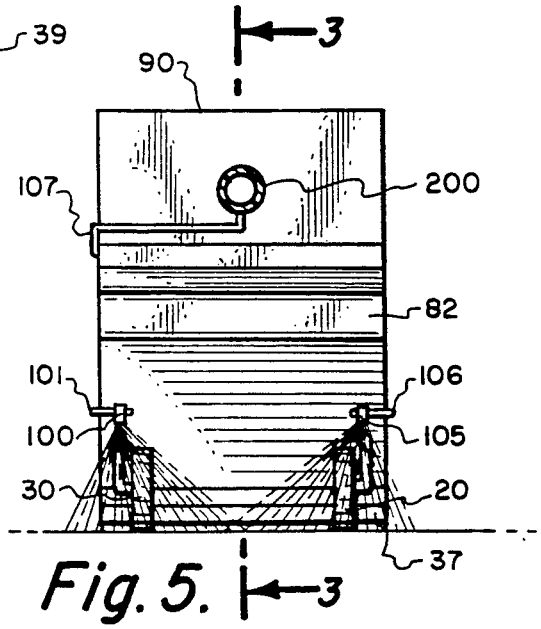
FIG. 5 is a front elevational view of the surface cleaning machine showing the takeup collecting chamber and separating chember portions of the return housing. The front braces, the two wheels, and the two water sprayers are shown attached to the front.

Referring back now to the broadcast chamber and the collecting chamber as shown in FIGS. 5 and 6. The angle formed between the broadcast chamber and the collecting chamber is variable but is normally within the range of 30 to 45 degrees.

There is a storage bin 351 located above the feed hopper and adjacent to the separating chamber 90. The storage bin holds a supply of abradant particles 70. A vertical tube 102 with a built-in valve 103 connects the bottom of the bin to the feed hopper 80. The valve can be opened to allow additional abradant particles to fill the feed hopper to the desired level. The feed hopper is a cone-shaped configuration. When the machine is stopped and the storage bin valve is opened, the particles will flow into the feed hopper until they reach the level of the bottom of the feed tube 102. The valve is then shut off. This is the normal level of the abradant particles in the feed hopper.

While the present invention has been shown and described herein in what is conceived to be the best mode contemplated, it is recognized that departures may be made therefrom within the scope of the invention which is therefore not to be limited to the details disclosed herein but is to be afforded the full scope of the invention.

What is claimed is:

1. A surface cleaning or preparing device comprising:

wheel supported frame means having front and rear;

rear housing means mounted on said frame means having a broadcast chamber inclined at an acute angle relative to the surface to be cleaned or prepared, and having an open bottom;

abrasion cavity means communicating with and positioned beneath said housing means;

motor means having a rotatable drive shaft, said shaft being positioned in said broadcast chamber;

broadcast wheel means mounted on said shaft in said broadcast chamber for centrifugally hurling abradant particles into said abrasion cavity means and against the surface to be cleaned or prepared thereby abrading said surface;

feed duct means for feeding abradant particles to said broadcast wheel means;

feed hopper means for holding a quantity of new and recycled abradant particles and for feeding abradant particles to said broadcast wheel through said feed duct means;

return housing means having a takeup collecting chamber means communicating with said abrasive cavity means for receiving abradant particles and abraded material rebounding from said surface;

separating chamber means for receiving abradant particles and abraded material and for allowing said abraded material to separate from said abradant particles allowing said abradant particles to return to said hopper means; and water sprayer means for wetting said surface before said surface is abraded, wherein said sprayer means is mounted on the front of said frame means exteriorly of said abrasion cavity means and directed at said surface in advance of said cavity means.

2. The device as recited in claim 1 including:

flexible hose means interconnecting said separating chamber means to a canister means;

canister means having a filter means for removing said abraded material from said separating chamber means and depositing it in said canister;

water sprayer means in said canister means for wetting down said abraded material;

means for supplying a vacuum to said canister means for drawing in air from said separating chamber means and said takeup collecting chamber.

3. The device as recited in claim 1 including:

handle means extending upwardly and rearwardly from said frame means for maneuvering said device;

particle valve control means for controlling the amount of abradant particles fed to said broadcast wheel;

means mounted on said handle for manually controlling said abradant particle valve control means;

air line means mounted on said handle means and connected to said motor means for supplying compressed air flow to said motor means;

means mounted on said handle for manually controlling said air flow to said motor means;

water line means mounted on said handle means and running to said sprayer means mounted on the front of said device;

water control means mounted on said handle means for manually controlling water flow to said sprayer means.

4. The device as recited in claim 1 wherein:

the angle formed between said broadcast chamber and said takeup collecting chamber is in the range of 30 degrees to 45 degrees.

5. The device as recited in claim 1 further comprising:

feed bin means for feeding abradant particles into said hopper.

6. The device as recited in claim 1 further comprising:

water line means from said water control means to the sprayer means.

7. A surface cleaning or preparing device for a flat area comprising:

wheel supported frame means;

hollow housing mounted rearwards on said frame means and having a broadcast chamber inclined at an acute angle relative to the surface to be cleaned or prepared, and having an open bottom;

pneumatic motor means mounted outside of said broadcast chamber of said hollow housing, and having a rotatable drive shaft positioned in said broadcast chamber;

broadcast wheel means mounted on said shaft of said pneumatic motor means in said broadcast chamber for centrifugally hurling abradant particles against the surface to be cleaned or prepared whenever compressed air is applied to said pneumatic motor means;

feed duct means having one end secured to said hollow housing on the side opposite that of said pneumatic motor for feeding blast particles to said broadcast wheel means;

feed hopper means mounted to the other end of said feed duct for holding a quantity of new and recycled abradant particles and for feeding abradant particles to said broadcast wheel through said feed duct;

control valve means mounted between said feed hopper means and said feed duct for controlling the amount of abradant particles dispensed to said broadcast wheel;

a generally rectangular-shaped magnetic frame mounted parallel to the surface to be cleaned or prepared and having a large rectangular opening;

said magnetic frame being mounted to said open bottom of said hollow housing, said open bottom of said hollow housing occupying generally the rear half of said large rectangular opening;

forward housing having a top, a bottom, and a take up collecting chamber mounted forward of said perimeter of said hollow housing and over said magnetic frame unoccupied by said hollow housing;

said bottom of said hollow housing and said bottom of said forward housing forming an airtight seal with the top side of said magnetic frame and an abrasion cavity within the large rectangular opening;

separating chamber means formed in a container positioned above and sealed to said hopper means for allowing said abradant particles to separate from the abraded material immediately removed from the surface being treated, and to allow said abradant particles to return to said hopper means;

said takeup collecting chamber terminating at said top of said forward housing and being vented into said separating chamber for venting said abradant particles and said abraded material to said separating chamber from said takeup collecting chamber in said forward housing;

flexible hose means attached to said separating chamber for removing abraded material from said separating chamber;

water sprayer means for wetting said surface before said surface is abraded, wherein said sprayer means is mounted on the front of said frame means exteriorly of said abrasion cavity and directed at the surface in advance of said abrasion cavity;

canister means for containing said abraded material;

means on said canister means for interconnecting the end of said flexible hose means coming from said separating chamber;

means including filter means for supplying a vacuum to said holding canister for circulating air from said takeup collecting chamber, said separating chamber, said flexible hose and through said filter means for removing said abraded material from the circulating air.

8. A surface cleaning or preparing device comprising:

wheel supported frame means;

housing means mounted on said frame means having a broadcast chamber inclined at an acute angle relative to the surface to be cleaned or prepared, and having an open bottom;

abrasion cavity means communicating with and positioned beneath said housing means;

broadcast means mounted in said broadcast chamber for hurling abradant particles into said abrasion cavity means and against the surface to be cleaned or prepared thereby abrading said surface;

feed duct means for feeding abradant particles to said broadcast means;

feed hopper means for holding a quantity of new and recycled abradant particles and for feeding abradant particles to said broadcast means through said feed duct means;

return housing means having a takeup collecting chamber means communicating with said abrasion cavity means for receiving abradant particles and abraded material rebounding from said surface;

separating chamber means for receiving abradant particles and abraded material and for allowing said abraded material to separate from said abradant particles allowing said abradant particles to return to said hopper means; and water sprayer means for wetting said surface before said surface is abraded, wherein said sprayer means is mounted on the front of said frame means exteriorly of said abrasion cavity and directed at the surface in advance of said abrasion cavity means.

9. Machine for abrading a surface, comprising:

an abradant receptacle for holding abradent particles;

an abrasion cavity adapted to be advanced across a surface to be abraded;

means for hurling abradent particles from the receptacle into the cavity and against the surface to be abraded, thereby to create abraded particles from the surface;

means for wetting said surface before surface is abraded, wherein said wetting means is mounted exteriorly and in advance of said abrasion cavity and directed at the surface in advance of said cavity;

means for receiving rebounded abradent and abraded particles and for separating the abradent particles from the abraded particles;

means for returning the abradent particles to said receptacle; and means for discharging the abraded particles.

* * * * *